US008540228B2

(12) United States Patent
Shiraishi

(10) Patent No.: US 8,540,228 B2
(45) Date of Patent: Sep. 24, 2013

(54) SHEET PROCESSING DEVICE AND IMAGE FORMING APPARATUS

(75) Inventor: Ryuuichi Shiraishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/041,950

(22) Filed: Mar. 7, 2011

(65) Prior Publication Data

US 2012/0018944 A1 Jan. 26, 2012

(30) Foreign Application Priority Data

Jul. 20, 2010 (JP) ..... 2010-163384

(51) Int. Cl.
*B65H 37/04* (2006.01)

(52) U.S. Cl.
USPC ..... 270/58.09; 270/58.07; 270/58.08

(58) Field of Classification Search
USPC ..... 270/58.07, 58.08, 58.09, 58.12, 58.17
See application file for complete search history.

(56) References Cited

U.S. PATENT DOCUMENTS

| | | | | |
|---|---|---|---|---|
| 3,577,575 | A * | 5/1971 | Taniguchi | 7/158 |
| 5,443,248 | A * | 8/1995 | Hayashi et al. | 270/58.09 |
| 5,772,198 | A * | 6/1998 | Yamamoto | 270/58.12 |
| 5,899,841 | A | 5/1999 | Berger | |
| 6,575,446 | B2 * | 6/2003 | Wakabayashi et al. | 270/58.07 |
| 7,789,383 | B2 * | 9/2010 | Grizzell | 270/58.08 |
| 2009/0256300 | A1 * | 10/2009 | Grizzell | 270/37 |

FOREIGN PATENT DOCUMENTS

| | | | |
|---|---|---|---|
| JP | 2004-168435 | A | 6/2004 |
| JP | 2004-002021 | | 8/2004 |
| JP | 2005-074787 | A | 3/2005 |
| JP | 2005-074858 | A | 3/2005 |
| JP | 3885410 | B2 | 12/2006 |
| JP | 4044416 | B2 | 11/2007 |

OTHER PUBLICATIONS

Notification of Reason for Refusal dated Jan. 10, 2012, issued in Japanese Patent Application No. 2010-163384.
Notification of Reason for Refusal dated Apr. 17, 2012, issued in Japanese Patent Application No. 2010-163384.

* cited by examiner

*Primary Examiner* — Leslie A Nicholson, III
(74) *Attorney, Agent, or Firm* — Sughrue Mion, PLLC

(57) ABSTRACT

A sheet processing device includes a stacking unit that is used to stack a bundle of sheets that are placed upon each other with first edge portions of the sheets being aligned with each other; a first binding unit that binds the first edge portions of the bundle of sheets stacked upon the stacking unit; a second binding unit that is provided integrally with the first binding unit in a direction along the first edge portions of the bundle of sheets stacked upon the stacking unit, and that binds the first edge portions by a binding method differing from a binding method of the first binding unit; and an angle changing mechanism that is capable of changing an angle of the first binding unit with respect to the bundle of sheets when binding the first edge portions with the first binding unit.

3 Claims, 11 Drawing Sheets

SHEET PROCESSING DEVICE AND IMAGE FORMING APPARATUS

CROSS-REFERENCE TO RELATED APPLICATIONS

This application is based on and claims priority under 35 USC 119 from Japanese Patent Application No. 2010-163384 filed Jul. 20, 2010.

BACKGROUND

(i) Technical Field

The present invention relates to a sheet processing device and an image forming apparatus.

SUMMARY

According to an aspect of the present invention, there is provided a sheet processing device including a stacking unit that is used to stack a bundle of sheets that are placed upon each other with first edge portions of the sheets being aligned with each other; a first binding unit that binds the first edge portions of the bundle of sheets stacked upon the stacking unit; a second binding unit that is provided integrally with the first binding unit in a direction along the first edge portions of the bundle of sheets stacked upon the stacking unit, the second binding unit binding the first edge portions by a binding method differing from a binding method of the first binding unit; and an angle changing mechanism that is capable of changing an angle of the first binding unit with respect to the bundle of sheets when binding the first edge portions with the first binding unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described in detail with reference to the attached drawings.

Image Forming System 1

Figure 1:
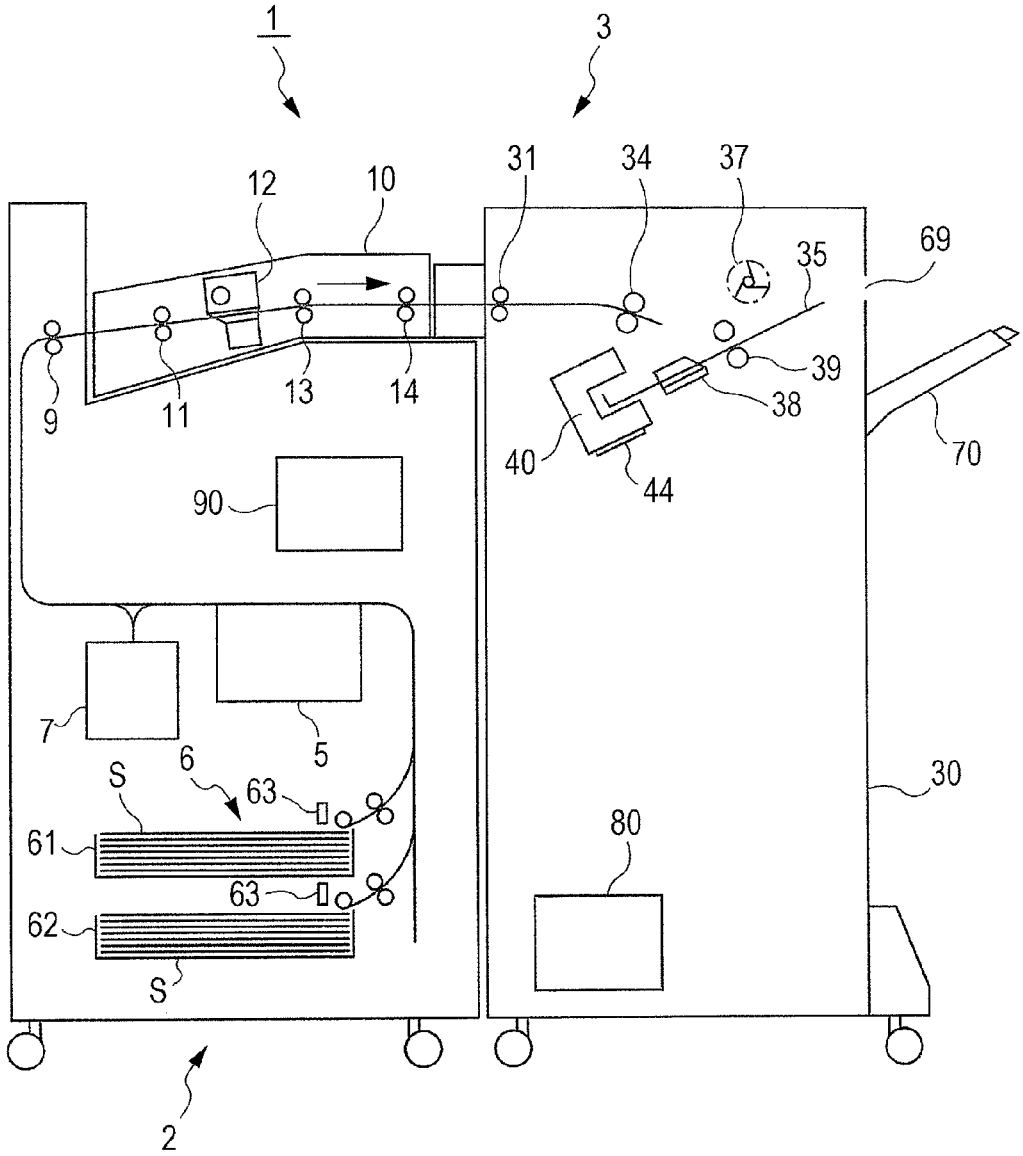
FIG. 1 is a schematic structural view of an image forming system to which an exemplary embodiment of the present invention is applied.

FIG. 1 is a schematic structural view of an image forming system 1 to which an exemplary embodiment of the present invention is applied. The image forming system 1 shown in FIG. 1 includes an image forming device 2, such as a printer or a copying machine, that forms images by electrophotography, and a sheet processing device 3 that performs a postprocessing operation on a sheet S on which, for example, a toner image is formed by the image forming device 2.

Image Forming Device 2

The image forming device 2 includes a sheet supplying section 6, an image forming section 5, a sheet reversing device 7, and discharge rollers 9. The sheet supplying section 6 supplies sheets S on which images are to be formed. The image forming section 5 forms the images on the sheets S supplied from the sheet supplying section 6. The sheet reversing device 7 reverses the surfaces of the sheets S on which the images are formed by the image forming section 5. The discharge rollers 9 discharge the sheets S on which the images are formed. The image forming device 2 also includes a user interface 90 that receives information regarding a binding operation from a user.

Here, the image forming section 5 serving as an exemplary image forming unit is formed so that the position where an image is to be formed on the sheet S is capable of being changed. That is, it is possible to change the distance from an edge portion of the sheet S to the image to be formed.

The sheet supplying section 6 includes a first sheet supplying loading section 61 and a second sheet supplying loading section 62, which have the sheets S loaded in the interiors thereof and which supply the sheets S to the image forming section 5. The sheet supplying section 6 also includes a first sheet supplying sensor 63 and a second sheet supplying sensor 64. The first sheet supplying sensor 63 detects whether or not there are any sheets S in the first sheet supplying loading section 61. The second sheet supplying sensor 64 detects whether or not there are any sheet S in the second sheet supplying loading section 62.

Sheet Processing Device 3

The sheet processing device 3 includes a transporting device 10 and a postprocessing device 30. The transporting device 10 transports the sheets S output from the image forming device 2 further downstream. The postprocessing device 30 includes, for example, a compiling stacking section 35 that gathers the sheets S and forms a bundle of sheets S, and a binding device 40 that binds edge portions of the sheets S. The sheet processing device 3 also includes a controller 80 that controls the entire image forming system 1.

The transporting device 10 of the sheet processing device 3 includes a pair of entrance rollers 11 and a puncher 12. The entrance rollers 11 receive the sheets S output through the discharge rollers 9 of the image forming device 2. The puncher 12 punches out holes in the sheets S received from the entrance rollers 11 if necessary. The transporting device 10 also includes a pair of first transporting rollers 13 that transport the sheets S further downstream from the puncher 12, and a pair of second transporting rollers 14 that transport the sheets S towards the postprocessing device 30.

The postprocessing device 30 of the sheet processing device 3 includes a pair of receiving rollers 31 that receive the sheets S from the transporting device 10. The postprocessing device 30 also includes the compiling stacking section 35 and a pair of exit rollers 34. The compiling stacking section 35 is provided downstream from the receiving rollers 31, and gathers and holds the sheets S. The exit rollers 34 discharge the sheets S towards the compiling stacking section 35.

The postprocessing device 30 further includes paddles 37 that rotate so as to push the sheets S to an end guide 35*b* (described later) of the compiling stacking section 35. Still further, the postprocessing device 30 includes tampers 38 for aligning the edge portions of the sheets S. Still further, the postprocessing device 30 includes eject rollers 39 which hold the sheets S gathered and stacked at the compiling stacking section 35 and which rotate to transport the bound bundle of sheets S downstream.

Still further, the postprocessing device 30 includes the binding device 40 that binds the edge portions of the bundle of sheets S gathered and stacked at the compiling stacking section 35. The postprocessing device 30 has an opening 69 used for discharging the bundle of sheets S to the outside of the postprocessing device 30 by the eject rollers 39. The postprocessing device 30 also has a stacking section 70 for stacking the bundle of sheets S discharged from the opening 69 so as to allow a user to easily take the bundle of sheets S.

Structure of Vicinity of Binding Unit

Figure 2:
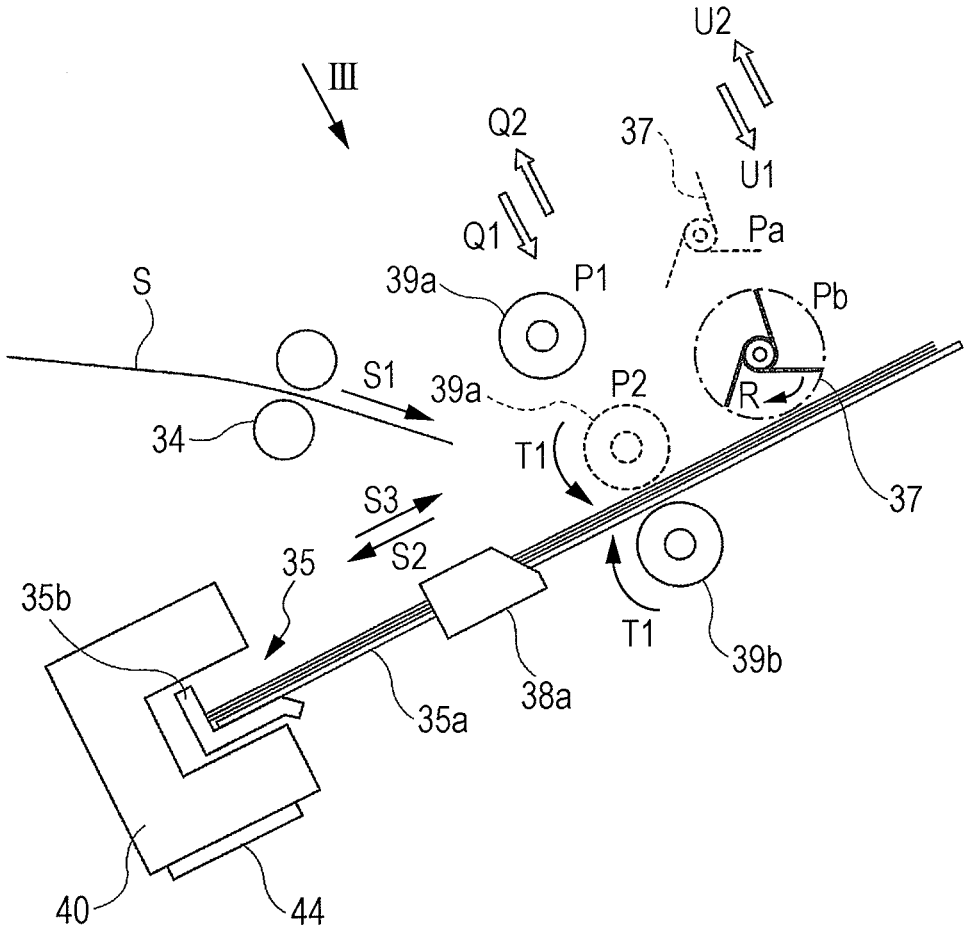
FIG. 2 is a schematic structural view of the vicinity of a compiling stacking section.
Figure 3:
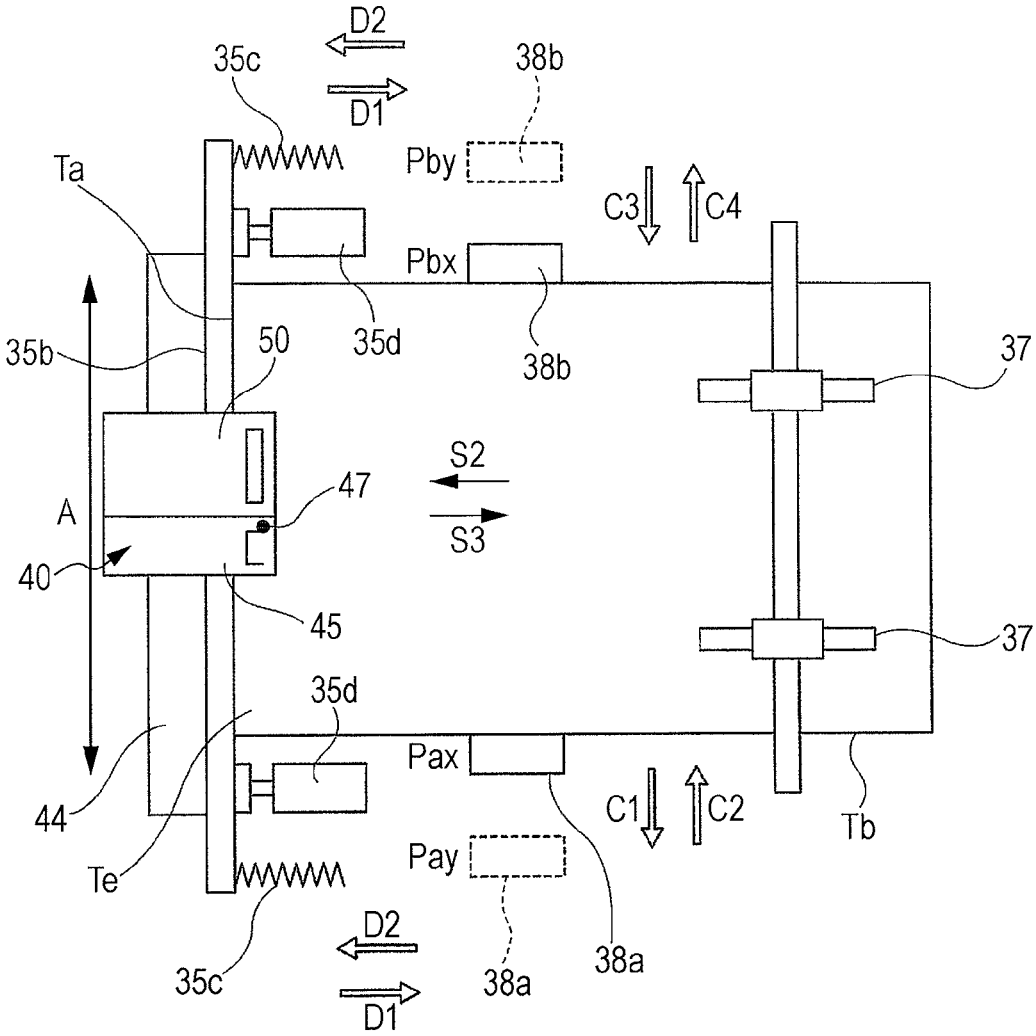
FIG. 3 is a schematic structural view of the vicinity of the compiling stacking section as viewed from the direction of arrow III shown in FIG. 2.
Figure 4A:
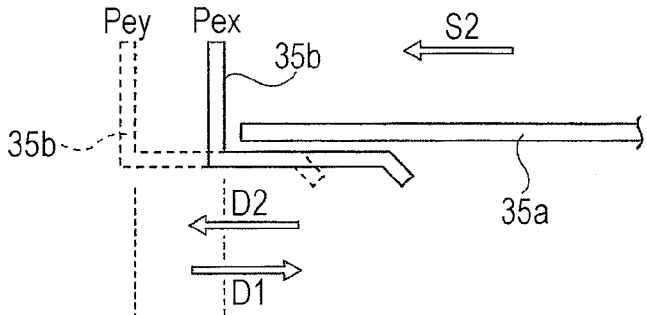
FIGS. 4A to 4C illustrate the relationships between an end guide and a sheet.
Figure 4B:
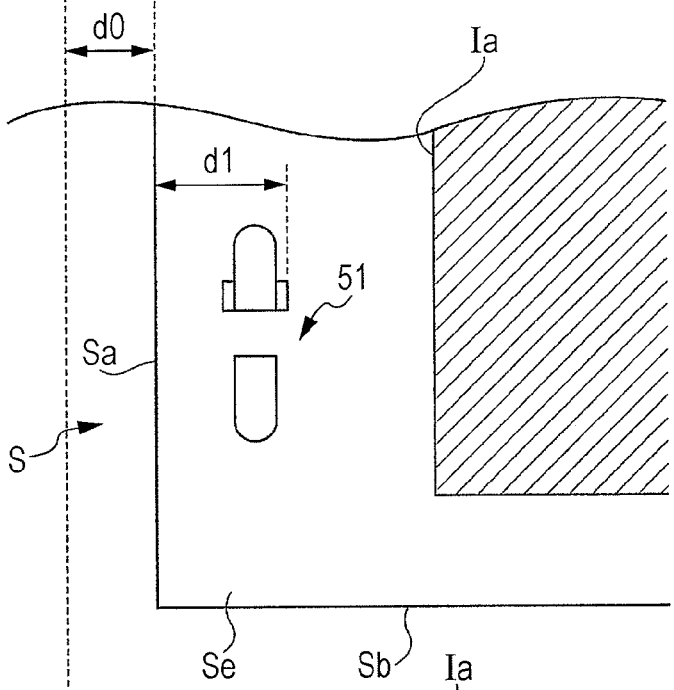
Figure 4C:
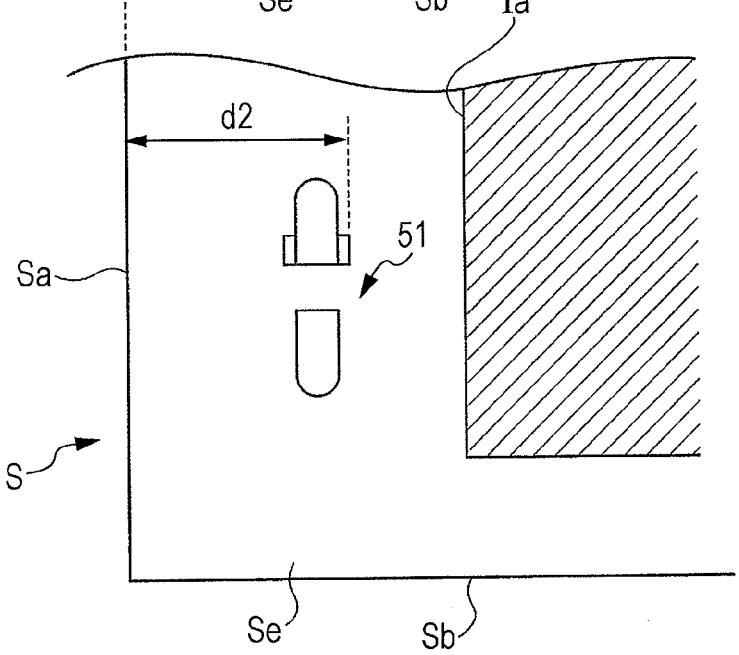

Next, with reference to FIGS. 2 to 4C, the compiling stacking section 35, and the binding device 40, etc., provided in the vicinity of the compiling stacking section 35, will be described. Here, FIG. 2 is a schematic structural view of the vicinity of the compiling stacking section 35, and FIG. 3 is a schematic structural view of the vicinity of the compiling stacking section 35 as viewed from the direction of arrow III shown in FIG. 2. FIGS. 4A to 4C illustrate the relationships between the end guide 35*b* and a sheet S. FIG. 4A illustrates the operation of the end guide 35*b*. FIG. 4B is a schematic view of the position of a binding portion when the end guide 35*b* is at a side where it is close to the sheet S. FIG. 4C is a schematic view of the position of the binding portion when the end guide 35*b* is at a side where it is further away from the sheet S.

In FIG. 2, for simplification, some of the members, such as an end guide spring 35*c*, are not shown. The lower side of FIG. 3 is a user side of the image forming system 1, that is, a near side in the plane of FIGS. 1 and 2.

The compiling stacking section 35, serving as an exemplary stacking unit, has a bottom portion 35*a* having an upper side on which the sheets S are stacked.

The bottom portion 35*a* is tilted so that the sheets S fall along the upper side thereof. In addition, the compiling stacking section 35 has the end guide 35*b* disposed so that the front edge portions in a sheet travelling direction of the sheets S that fall along the bottom portion 35*a* are aligned.

Although described in detail later, the sheets S at the vicinity of the compiling stacking section 35 are first supplied towards the compiling stacking section 35 (refer to a first traveling direction S1 in FIG. 2), and then, the traveling direction is reversed so that the sheets S drop along the bottom portion 35*a* of the compiling stacking section 35 (refer to a second traveling direction S2 in FIG. 2). Thereafter, the edge portions of the sheets S are aligned to form a bundle of sheets S. Then, the traveling direction is reversed so that the bundle of sheets S moves upward along the bottom portion 35*a* of the compiling stacking section 35 (refer to a third traveling direction S3 in FIG. 2).

Here, as shown in FIG. 3, in the exemplary embodiment, each edge portion of the bottom portion 35*a* of the compiling stacking section 35 is defined as follows. First, the edge portion at the front side in the second traveling direction S2 of the bottom portion 35*a* (indicating the direction in which the sheets S fall along the upper side of the bottom portion 35*a* of the compiling stacking section 35) is called a front-side edge portion Ta. Next, the edge portion extending in the second traveling direction S2 and disposed at the user side (that is, the lower side in FIG. 3) of the image forming system 1 is called a side edge portion Tb. A portion that is provided between the front-side edge portion Ta and the side edge portion Tb is called a corner Te.

As shown in FIGS. 4B to 4C, in the exemplary embodiment, respective portions of the sheets S disposed on the bottom portion 35*a* of the compiling stacking section 35 are defined as follows. First, the edge portion of each sheet S extending along the front-side edge portion Ta and contacting the end guide 35*b* is called a first edge portion Sa. The edge portion intersecting the first edge portion Sa and extending along the side edge portion Tb is called a second edge portion Sb. Further, a portion of each sheet S provided between the first edge portion Sa and the second edge portion Sb is called a corner Se.

Further, as shown in FIGS. 4B and 4C, in the exemplary embodiment, an edge of an image (formed on the sheet S) at the side of the first edge portion Sa is called an image edge Ia.

As shown in FIG. 4A, the end guide 35*b* is provided so as to be capable of moving towards and away from the bottom portion 35*a* of the compiling stacking section 35 (refer to arrows D1 and D2). More specifically, the end guide 35*b* has the following structure.

First, in the up-down direction in FIG. 3, the end guide 35*b* is longer than the bottom portion 35*a* of the compiling stacking section 35. In addition, a pair of end guide springs 35*c* and a pair of solenoids 35*d* are connected, one end guide spring 35*c* and one solenoid 35*d* being connected to one end of the end guide 35*b*, and the other end guide spring 35*c* and the other solenoid 35*d* being connected to the other end of the end guide 35*b*. The end guide springs 35*c* and the solenoids 35*d* are disposed at the same side of the end guide 35*b* (that is, at the right side of the end guide 35*b* in FIG. 3). The end guide springs 35*c* are compressed, and are disposed so as to push the end guide 35*b* (refer to the arrows D2). Shafts of the solenoids 35*d* are capable of being extended, with one end of each shaft being connected to the end guide 35*b*.

Here, as shown in FIG. 4A, the end guide 35*b* is movable between a position Pex where the end guide 35*b* is close to the bottom portion 35*a* and a position Pey where the end guide 35*b* is further away from the bottom portion 35*a*. The distance between the positions Pex and Pey is d0.

When the solenoids 35*d* are not operating, the end guide 35*b* is pushed by the compressed end guide springs 35*c*, and disposed at the position Pey that is further away from the bottom portion 35*a*. In contrast, when the solenoids 35*d* are operating, the solenoids 35*d* cause the end guide 35*b* to move towards the bottom portion 35*a*, so that the end guide 35*b* is disposed at the position Pex that is close to the bottom portion 35*a*.

Here, moving of the position of a binding portion of a sheet by moving of the end guide 35*b* will be described.

First, the case in which the end guide 35*b* is disposed at the position Pex will be described. The end guide 35*b* is disposed at the position Pex. Then, a sheet S is supplied to the bottom portion 35*a* of the compiling stacking section 35 and is disposed so that the first edge portion Sa of the sheet S contacts the end guide 35*b*. When, in this state, a binding operation is performed, the distance from the first edge portion Sa to a portion where the binding operation is performed is reduced. In contrast, when the end guide 35*b* is disposed at the position Pey, if the sheet is disposed at the bottom portion 35*a* of the compiling stacking section 35 and is subjected to the binding operation, the distance from the first edge portion Sa to a portion where the binding operation is performed is increased. This is described in more detail below.

That is, if the stapleless binding mechanism 50 performs the binding operation when the end guide 35*b* is disposed at the position Pex, the distance from an edge of the binding portion situated away from the first edge portion Sa to the first edge portion Sa becomes a distance d1 (see FIG. 4B). In contrast, if the stapleless binding mechanism 50 performs the binding operation when the end guide 35*b* is disposed at the position Pey, the distance from the edge of the binding portion situated away from the first edge portion Sa to the first edge portion Sa becomes a distance d2 (see FIG. 4C). The distance d2 is longer than the distance d1 by, for example, approximately 3 to 5 mm.

Although, in FIGS. 4A to 4C, the case in which the stapleless binding mechanism 50 performs the binding operation (in which a stapleless binding portion 51 is disposed (described in detail later)) is described, a stapler 45 may be used to perform a binding operation (in which a staple 41 is disposed (described later)). That is, the end guide 35*b* is formed so that the distance from the first edge Sa of a sheet S to a binding portion is capable of being changed even if the binding operation is performed by either one of the stapleless binding mechanism 50 and the stapler 45.

Each member of the image forming system 1 will be described again. The paddles 37 are provided above the compiling stacking section 35, and downstream in the first traveling direction S1 of the sheet S from the exit rollers 34. The paddles 37 are provided so that their distance from the bottom portion 35*a* of the compiling stacking section 35 changes when the paddles 37 are driven by, for example, a motor (not shown). More specifically, the paddles 37 are provided so as to be movable in the direction of arrow U1 and the direction of arrow U2 in FIG. 2. The paddles 37 move in the direction of arrow U1 to move towards the bottom portion 35*a* of the compiling stacking section 35 (that is, move to a position Pb indicated by a solid line). The paddles 37 move in the direction of arrow U2 to move away from the bottom portion 35*a* of the compiling stacking section 35 (that is, move to a position Pa indicated by broken lines). The paddles 37 rotate in the direction of arrow R in FIG. 2, so that the sheet S transported along the first traveling direction S1 in FIG. 2 is pushed in the second traveling direction S2 at the compiling stacking section 35.

The tampers 38 (see FIG. 1) include a first tamper 38*a* and a second tamper 38*b* opposing each other with the compiling stacking section 35 being disposed therebetween. More specifically, the first tamper 38*a* and the second tamper 38*b* are disposed so as to oppose each other in a direction intersecting the second traveling direction S2 (that is, the up-down direction in FIG. 3). The first tamper 38*a* and the second tamper 38*b* are provided so that the distance between the first tamper 38*a* and the second tamper 38*b* changes when driving force of, for example, a motor (not shown) is applied thereto.

Here, the tampers 38 are formed so that the edge portions extending along the traveling direction of the sheets S that fall along the bottom portion 35*a* are aligned. More specifically, the first tamper 38*a* is disposed so as to move in the directions of arrows C3 and C4 between a position where the first tamper 38*a* is close to the compiling stacking section 35 (that is, a position Pax indicated by a solid line) and a position where the first tamper 38*a* is further away from the compiling stacking section 35 (that is, a position Pay indicated by broken lines). The second tamper 38*b* is disposed so as to move in the directions of arrows C3 and C4 between a position where the second tamper 38*b* is close to the compiling stacking section 35 (that is, a position Pbx indicated by a solid line) and a position where the second tamper 38*b* is further away from the compiling stacking section 35 (that is, a position Pby indicated by broken lines).

The positions Pax and Pay of the first tamper 38*a* and the positions Pbx and Pby of the second tamper 38*b* in the exemplary embodiment are capable of being changed in accordance with the size and orientation of the sheets S supplied to the compiling stacking section 35.

The eject rollers 39 include a first eject roller 39*a* and a second eject roller 39*b*. The first eject roller 39*a* and the second eject roller 39*b* are disposed above and below the bottom portion 35*a* so as to oppose each other with the bottom portion 35*a* of the compiling stacking section 35 being disposed therebetween.

In addition, the first eject roller 39*a* is provided at a side of the bottom portion 35*a* of the compiling stacking section 35 where the sheets S are stacked. The first eject roller 39*a* is provided so as to be capable of moving towards and away from the second eject roller 39*b* when a driving force of, for example, a motor (not shown) is applied. That is, the distance between the first eject roller 39*a* and the sheets S that are stacked upon the bottom portion 35*a* of the compiling stacking section 35 is changeable. In contrast, the second eject roller 39*b* is disposed at a side of the bottom portion 35*a* of the compiling stacking section 35 that is below the side where the sheets S are stacked. The position of the second eject roller 39*b* is fixed. The second eject roller 39*b* only rotates.

More specifically, the first eject roller 39*a* moves in the direction of arrow Q1 to move towards the bottom portion 35*a* of the compiling stacking section 35 (a position P2 indicated by broken lines). In contrast, the first eject roller 39*a* moves in the direction of arrow Q2 to move away from the bottom portion 35*a* of the compiling stacking section 35 (a position P1 indicated by a solid line).

The first eject roller 39*a* receives a driving force of, for example, a motor (not shown) while it contacts the sheets S, and rotates in the direction of arrow T1, so that a bundle of sheets S moves upward (in the third traveling direction S3) and is transported.

The positions P1 and P2 of the first eject roller 39*a* are changeable in accordance with the number of and thickness of the sheets S that are supplied to the compiling stacking section 35.

Binding Device 40

Figure 5:
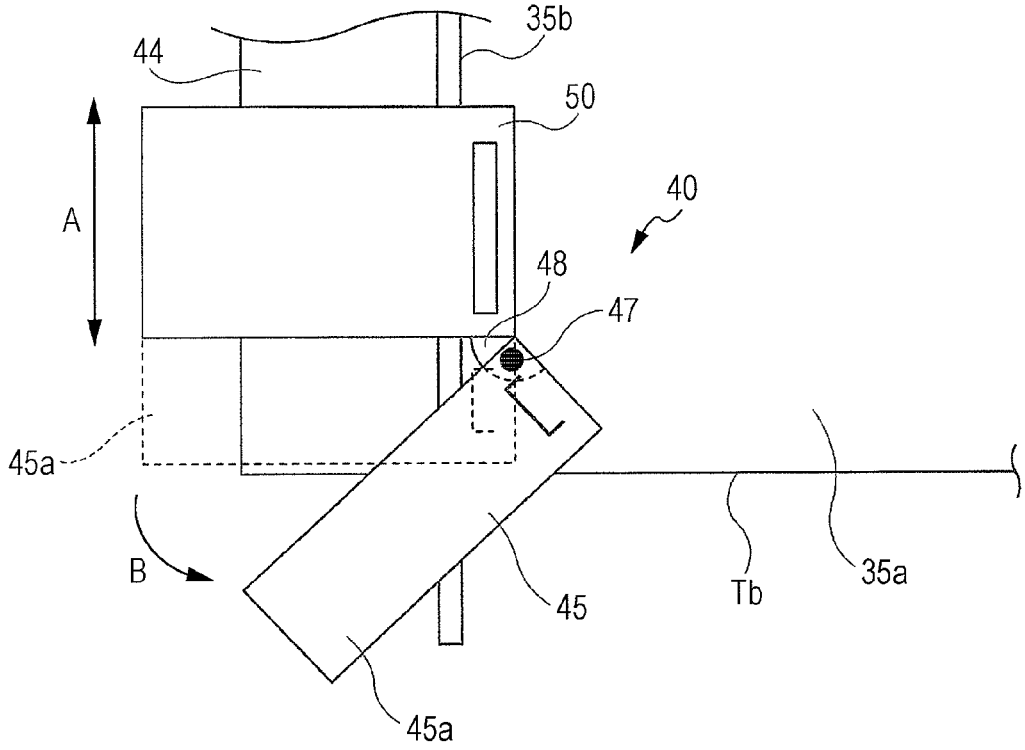
FIG. 5 illustrates the structure of a binding device.
Figure 6A:
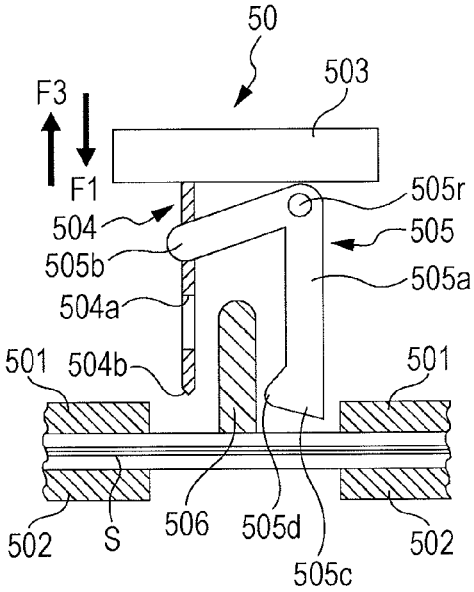
FIGS. 6A to 6D illustrate the structure of a stapleless binding mechanism and a portion to which a stapleless binding operation is performed.
Figure 6B:
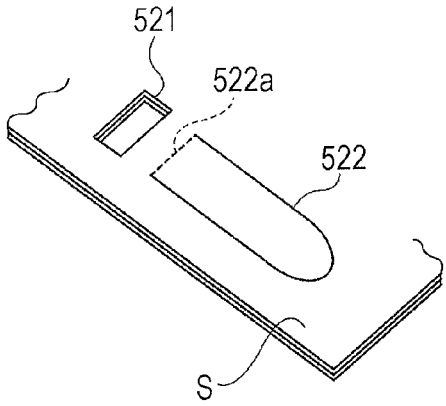
Figure 6C:
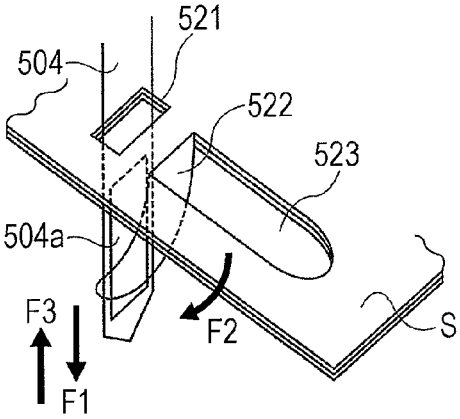
Figure 6D:
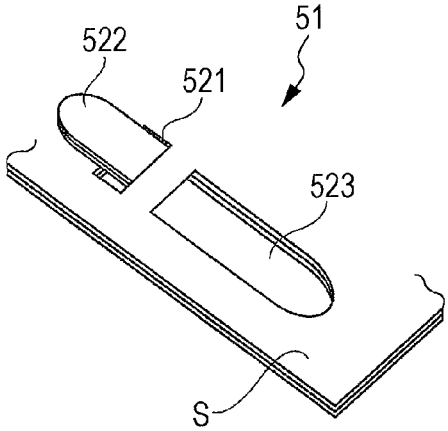

Next, the binding device 40 will be described with reference to FIGS. 3 and 6A to 6D. Here, FIG. 5 illustrates the structure of the binding device 40. FIGS. 6A to 6D illustrate the structure of the stapleless binding mechanism 50 and a portion to which a stapleless binding operation is performed. FIG. 6A illustrates the structure of the stapleless binding mechanism 50. FIG. 6B illustrates a slit 521 and a flap 522 formed in a sheet S. FIG. 6C illustrates an operation in which the flap 522 is inserted into the slit 521. FIG. 6D illustrates the portion where a binding operation is performed by the stapleless binding mechanism 50.

The binding device 40 includes the stapler 45, serving as an exemplary first binding unit and as an exemplary staple binding unit, and the stapleless binding mechanism 50 serving as an exemplary second binding unit and an exemplary sheet binding unit. The stapler 45 is formed so that, by pushing staples 41 (described below) one by one into the sheets S, the edge portions of the bundle of sheets S held by the compiling stacking section 35 are bound. The stapleless binding mechanism 50 is formed so that the edge portions of the bundle of sheets S held by the compiling stacking section 35 are bound by processing portions of the sheets S without using the staples 41. The stapler 45 and the stapleless binding mechanism 50 are connected to each other through a joint 48, and are continuously provided along the front-side edge portion Ta.

The stapler 45 is disposed closer to the user side (that is, the lower side in FIG. 3) of the image forming system 1 than the stapleless binding mechanism 50. When the stapler 45 is disposed closer to the user side (that is, the lower side in FIG. 3), it is possible to easily perform maintenance on the stapler 45, such as replenishing the stapler 45 with the staples 41.

Here, whereas the stapler 45 uses the staples 41, the stapleless binding mechanism 50 does not use members that need to be replenished, such as the staples 41. The stapler 45 is more frequently maintained than the stapleless binding mechanism 50. Therefore, the stapler 45 is capable of being more easily maintained.

The binding device 40 is disposed on a rail 44 so as to be movable along the front-side edge portion Ta by a motor (not shown) (refer to a double-headed arrow A in FIG. 3). In addition, the stapler 45 and the stapleless binding mechanism are capable of binding any position at the side of the front-side edge portion Ta of the bottom portion 35*a*.

Stapler 45

The stapler 45 is formed so as to perform binding at the corner Te of the bottom portion 35*a* in addition to at the side of the front-side edge portion Ta of the bottom portion 35*a*. The stapler 45 differs on this point from the stapleless binding mechanism 50 that performs binding only at the side of the front-side edge portion Ta of the bottom portion 35*a*.

More specifically, the stapler 45 has the following structure.

The stapler 45 has a rotational shaft 47 adjacent to the stapleless binding mechanism 50 and at the side of the front-side edge portion Ta. The rotational shaft 47 is connected to a motor (not shown).

When a motor (not shown), serving as an exemplary angle changing mechanism, is driven, the stapler 45 is rotatable around the rotational shaft 47 (refer to arrow B). That is, the stapler 45 has a rotating structure. Here, the stapler 45 is capable of rotating independently of the stapleless binding mechanism 50 with the connection between the stapler 45 and the stapleless binding mechanism 50 through the joint 48 being maintained. The rotation of the stapler 45 does not move the stapleless binding mechanism 50.

The stapler 45 is formed so that, by pushing the staples 41 (described below) one by one into the sheets S, the edge portions of the bundle of sheets S held by the compiling stacking section 35 are bound. That is, a stapler motor (not shown) is driven, and the stapler 45 pushes one staple 41 (described later) into the bundle of sheets S. When the staple 41 is pushed into the bundle of sheets S, and the ends of the staples 41 are bent at the opposite side of the bundle of sheets S, the bundle of sheets S is bound. With the pushed-in staple 41 being tilted with respect to the first edge portions Sa of the sheets S, the staple 41 is disposed in the corners Se of the sheets S.

Stapleless Binding Mechanism 50

The stapleless binding mechanism 50 is formed so that the edge portions of the bundle of sheets S held by the compiling stacking section 35 are bound without using the staples 41 (discussed later). More specifically, the stapleless binding mechanism 50 has the following structure.

The stapleless binding mechanism 50 has a base 501 and a base section 503 disposed opposite each other. As shown in FIG. 6A, the stapleless binding mechanism 50 is formed so that, when the base section 503 moves towards the base section 501 (in the direction of an illustrated arrow F1) while a bundle of sheets S is interposed at the base 501, the bundle of sheets S is capable of being bound.

A bottom member 502 is disposed parallel to the base 501 so that the sheets S are interposed between the base 501 and the bottom member 502. The base 501 is provided with a protrusion 506 extending towards the base section 503 and formed integrally with the base 501.

The base section 503 is provided with a blade 504 and a punching member 505. The blade 504 forms a cut in the bundle of sheets S. The punching member 505 forms and bends the flap 522 (described later) in the bundle of sheets S, and inserts the flap 522 into the cut formed by the blade 504.

The blade 504 is a substantially rectangular plate-like member that extends towards the bundle of sheets S interposed between the base 501 and the bottom member 502. More specifically, the blade 504 has an eyelet 504*a* and a tip 504*b*. The eyelet 504*a* is formed in a substantially rectangular surface of the blade 504. The width of the tip 504*b* becomes smaller as the tip 504*b* extends towards the sheets S.

The punching member 505 has an L-shaped bent portion. One end portion of the punching member 505 corresponds to a principle portion 505*a*, and the other end portion corresponds to an auxiliary portion 505*b*.

The punching member 505 has a principle-portion rotational shaft 505*r* provided at the L-shaped bent portion. The punching member 505 is rotatable around the principle-portion rotational shaft 505*r*. More specifically, the principle portion 505*a* is tiltable towards the blade 504. A gap is formed between the auxiliary portion 505*b* and the base section 503 so as to allow the punching member 505 to rotate.

Here, the principle portion 505*a* extends towards the base section 501. The principle portion 505*a* has a cutter portion 505*c* at a side opposite to the side where the principle-portion rotational shaft 505*r* is provided, that is, at a side opposing the base 501. The cutter portion 505*c* includes a cutting edge that punches out the shape of the flap 522. The cutter portion 505*c* does not have a cutting edge at a side opposing the blade 504. That is, the cutter portion 505*c* is formed so that the flap 522 and the sheets S are continuously provided at an end portion 522*a* (described later). Further, the principle portion 505*a* is provided with a protrusion 505*d* extending towards the blade 504 at a side portion of the principle portion 505*a*, more specifically, at the side opposing the blade 504.

A binding operation of the stapleless binding mechanism 50 is as follows.

That is, a stapleless binding motor (not shown) is driven to cause the base section 503 to move towards the base section 501, so that the tip 504*b* of the blade 504 and the cutter portion 505*c* of the punching member 505 are driven through a bundle of sheets S. As shown in FIG. 6B, the slit 521 (serving as an exemplary cut) and the flap 522 (serving as an exemplary partially punched sheet piece) are formed in the bundle of sheets S through which the tip 504*b* and the cutter portion 505*c* are driven. The flap 522 is formed by punching a portion of the bundle of sheets S with the end portion 522*a* kept attached to the bundle of sheets S.

When the base section 503 is further pushed, the auxiliary portion 505*b* of the punching member 505 strikes the protrusion 506 integrally formed with the base 501, so that the punching member 505 rotates clockwise around the principle-portion rotational shaft 505*r* in FIG. 6A. By this, the principle portion 505*a* is tilted towards the blade 504, and the protrusion 505*d* of the punching member 505 moves towards the blade 504. Then, as shown in FIG. 6C, the protrusion 505*d* of the punching member 505 bends the flap 522, and pushes the flap 522 towards and into the eyelet 504*a* of the blade 504 in the illustrated direction of arrow F2. In FIG. 6C, the punching member 505 is not shown.

In this state, the base section 503 is moved away from the base 501. That is, when the base section 503 is raised in the illustrated direction of arrow F3, the flap 522 is raised with the flap 522 being caught in the eyelet 504*a* of the blade 504. Then, as shown in FIG. 6D, the flap 522 is inserted into the slit 521, to bind the bundle of sheets S. At this time, a binding hole 523 is formed in the bundle of sheets S where the flap 522 is punched from the bundle of sheets S.

Comparison of Binding Portions

Figure 7A:
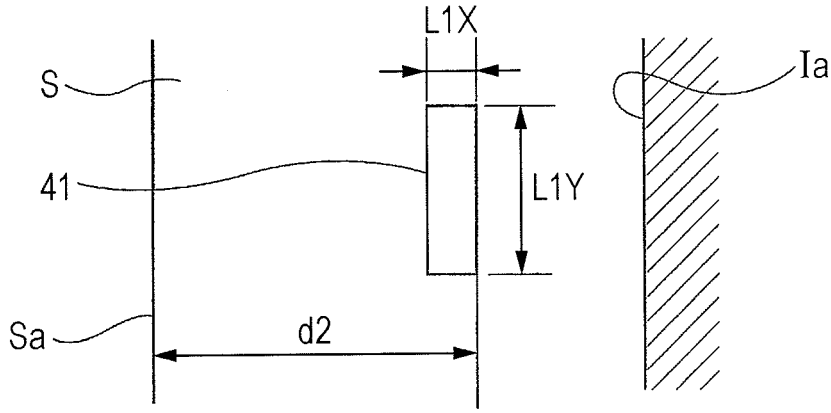
FIGS. 7A and 7B are schematic structural views showing portions where binding operations are performed by a stapler and the stapleless binding mechanism, respectively.
Figure 7B:
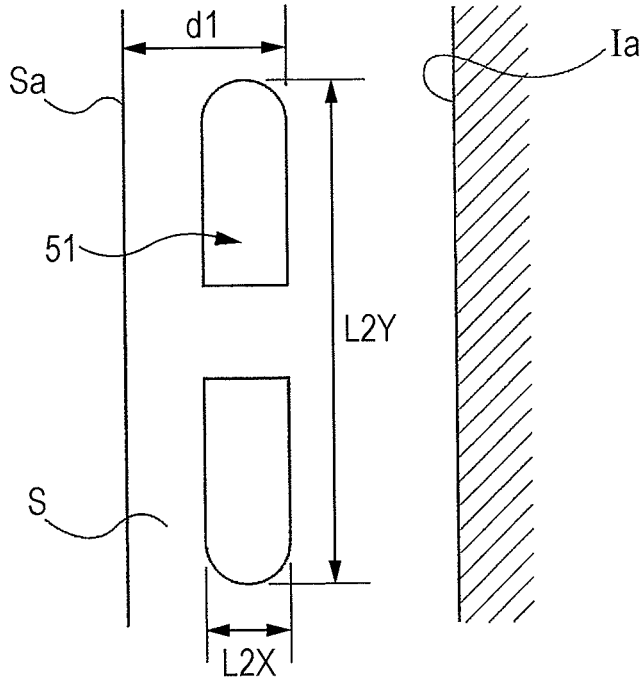

Next, with reference to FIGS. 7A and 7B, portions that are bound by the stapler 45 and the stapleless binding mechanism 50 will be described. Here, FIGS. 7A and 7B are schematic structural views showing portions where binding operations are performed by the stapler 45 and the stapleless binding mechanism 50.

First, a staple 41 is disposed in a portion that is to be bound by the stapler 45. In contrast, a stapleless binding portion 51 is formed in a portion to be bound by the stapleless binding mechanism 50.

The staple 41 and the stapleless binding portion 51 are disposed so that they do not overlap images to be formed on the sheets S. This is for preventing the images that are formed from becoming invisible.

A widthwise-direction length of the stapleless binding portion 51 (that is, a length L2X) is longer than a widthwise-direction length of the staple 41 (that is, a length L1X). A longitudinal-direction length of the stapleless binding portion 51 (that is, a length L2Y) is longer than a longitudinal-direction length of the staple 41 (that is, a length L1Y). Therefore, the area of the stapleless binding portion 51 is also larger than the area of the staple 41.

In the exemplary embodiment, the staple 41 is used for the binding operation at the corner Te of the bottom portion 35*a* because the longitudinal-direction length of the staple 41 is shorter than that of the stapleless binding portion 51. If the stapleless binding portion 51 having the longer longitudinal-direction length is disposed obliquely with respect to the corner Te of the bottom portion 35*a*, the stapleless binding portion 51 is disposed towards the central portion of the sheet S. Therefore, the possibility with which the binding portion 51 overlaps the image formed on the sheet S is increased.

Further, the stapleless binding portion 51 includes the binding hole 523 formed by punching the flap 522. As a result, a portion extending from the binding hole 523 to the first edge portion Sa of each sheet S tends to be torn. In particular, when other members are passed through the binding hole 523 (formed in the sheets S) for filing, the sheets S tend to become torn. Therefore, in order to prevent the sheets S from becoming torn, it is necessary for the stapleless binding portion 51 to be disposed at a certain distance from the first edge portion Sa of each sheet S.

In other words, it is necessary for the stapleless binding portion 51 to have a wider binding margin than the staple 41. Here, the term "binding margin" refers to an edge portion of a sheet S where an image is not formed. For example, the binding margin of the sheet S close to the first edge portion Sa refers to a portion of the sheet S extending to the first edge portion Sa from an image edge Ia situated at the side of the first edge portion Sa of the sheet S.

In order to prevent tearing of the sheet S, a required distance from the stapleless binding portion 51 to the first edge portion Sa of the sheet S is changed depending upon the number of sheets S to be bound and the strengths of the materials of the sheets S to be bound.

Operation of Image Forming System 1

Next, the operation of the image forming system 1 will be described with reference to FIGS. 1 to 4C. Here, the case in which the stapler 45 of the binding device 40 performs a binding operation at the front-side edge portion Ta will be described.

First, in a state prior to forming a toner image on a first sheet S by the image forming section 5 of the image forming device 2, each member is disposed as follows. That is, the first eject roller 39*a* is disposed at the position P1, the paddles 37 are disposed at the position Pa, the first tamper 38*a* is disposed at the position Pay, and the second tamper 38*b* is disposed at the position Pbx. The end guide 35*b* is disposed at the position Pey that is further away from the bottom portion 35*a*.

Then, the toner image is formed on the first sheet S by the image forming section 5 of the image forming device 2. As shown in FIG. 1, after the first sheet S on which the toner image is formed is reversed by the sheet reversing device 7 as required, the sheets S are supplied one at a time to the sheet processing device 3 through the discharge rollers 9.

In the transporting device 10 of the sheet processing device 3 to which the first sheet S is supplied, the first sheet S is received through the entrance rollers 11, and, if necessary, holes are punched in the first sheet S with the puncher 12. Thereafter, the first sheet S is transported downstream towards the postprocessing device 30 through the first transporting rollers 13 and the second transporting rollers 14.

The postprocessing device 30 receives the first sheet S through the receiving rollers 31. The first sheet S that passes through the receiving rollers 31 is transported along the first traveling direction S1 by the exit rollers 34. The first sheet S passes between the compiling stacking section 35 and the first eject roller 39*a* and between the compiling stacking section 35 and the paddles 37.

After the front edge in the first traveling direction S1 of the first sheet S passes between the compiling stacking section 35 and the paddles 37, the paddles 37 move downward from the position Pa in the direction of arrow U1 in FIG. 2, and are disposed at the position Pb. This causes the paddles 37 to contact the first sheet S. Rotation in the direction of arrow R of the paddles 37 shown in FIG. 2 causes the first sheet S to be pushed in the second traveling direction S2 in FIG. 2, so that an edge portion of the first sheet S at the side of the end guide 35*b* contacts the end guide 35*b*. Thereafter, the paddles 37 move upward in the direction of arrow U2 in FIG. 2, separate from the first sheet S1, and are disposed again at the position Pa.

Then, after the compiling stacking section 35 receives the first sheet S, and the edge portion of the first sheet S at the side of the end guide 35*b* reaches the end guide 35*b*, the first tamper 38*a* moves towards the compiling stacking section 35 in the direction of arrow C2 in FIG. 3 from the position Pay. At this time, the second tamper 38*b* is kept at the position Pbx. By this, the first tamper 38*a* pushes the first sheet S, and the first sheet S contacts the second tamper 38*b*. Thereafter, the first tamper 38*a* moves away from the compiling stacking section 35 in the direction of arrow C1 in FIG. 3, so that the first tamper 38*a* separates from the first sheet S, and is disposed again at the position Pay.

As in the above-described operation, a second sheet S and sheets S following the second sheet S having toner images formed thereon by the image forming section 5 have their edge portions aligned by the paddles 37 and the tampers 38 when they are successively supplied to the postprocessing device 30. That is, with the first sheet S being aligned, the second sheet S is supplied, so that the second sheet S is aligned with the first sheet S. This also similarly applies to the case in which a third sheet S and sheets S following the third sheet S are supplied. Accordingly a preset number of sheets S is held by the compiling stacking section 35, and the edge portions of the respective sheets S are aligned, to form a bundle of sheets S.

Then, the first eject roller 39*a* is moved downward from the position P1 in the direction of arrow Q1 in FIG. 2, and is disposed at the position P2. This causes the bundle of aligned sheets S to be nipped between the first eject roller 39*a* and the second eject roller 39*b*, and to be fixed.

Next, the edge portions of the bundle of sheets S stacked on the compiling stacking section 35 are bound by the stapler 45. More specifically, the binding device 40 is moved along the rail 44 by a motor (not shown) (refer to arrow A), so that the stapler 45 opposes a portion where a binding operation is to be performed. Then, a stapler motor (not shown) is driven, and the stapler 45 pushes a staple 41 into the bundle of sheets S, to perform the binding operation. At this time, the distance from an end of the staple 41 situated away from the first edge portion Sa to the first edge portion Sa becomes the distance d2.

The bundle of sheets S bound by the stapler 45 is discharged from the compiling stacking section 35 by the rotation of the first eject roller 39*a* in the direction of arrow T1 in FIG. 2. Then, the bundle of sheets S passes through the opening 69, and is discharged to the stacking section 70.

Binding Operation at Corner Te

Next, an operation when the stapler 45 performs a binding operation at the corner Te of the bottom portion 35*a* will be described. Here, operational features that differ from those of the above-described image forming system 1 will only be described.

First, after the bundle of aligned sheets S is nipped by the first eject roller 39*a* and the second eject roller 39*b*, and is fixed, when a motor (not shown) is driven, the binding device 40 moves along the rail 44, and moves towards the corner Te of the bottom portion 35*a*.

At the position where the binding device 40 is disposed adjacent to the corner Te, a motor (not shown) rotates, to rotate the stapler 45 (refer to arrow B). More specifically, the stapler 45 moves from a position where it is continuous with the stapleless binding mechanism 50 (refer to the stapler 45 illustrated by broken lines in FIG. 5) to a position where it opposes the corner Te of the bottom portion 35*a* (refer to the stapler 45 illustrated by a solid line in FIG. 5). In other words, first, the stapler 45 and the stapleless binding mechanism 50 are integrated to each other by being connected to each other through the joint 48. Then, when the stapler 45 is rotated around the rotational shaft 47, the stapler 45 moves in the direction in which it separates from the stapleless binding mechanism 50 while the connection between the stapler 45 and the stapleless binding mechanism 50 through the joint 48 is maintained.

The stapler 45 whose angle is changed is driven by the stapler motor (not shown) at the position opposing the corner Te. This causes the staple 41 to be pushed into the sheets S.

The stapler 45 is capable of being rotated (refer to arrow B) without moving the position of the stapleless binding mechanism 50 (for example, without rotating the stapleless binding mechanism 50). Here, for example, a portion of the binding device 40 that protrudes in an outer peripheral direction of the compiling stacking section 35 is smaller when only the stapler 45 is rotated than when both the stapler 45 and the stapleless binding mechanism 50 are rotated in order to cause the stapler 45 to oppose the corner Te. Therefore, in the exemplary embodiment, only the stapler 45 is rotated. Consequently, it is possible to reduce the size of the sheet processing device 3.

Here, although the rotation of the stapler 45 by driving a motor is described as a method of changing the angle of the stapler 45, the present invention is not limited thereto.

For example, it is possible to provide the stapler 45 with a hook, and to provide a side of the rail 44 that is close to the corner Te with a protrusion that is caught by the hook. As the binding device 40 moves towards the corner Te, the hook and the protrusion engage each other. When a force generated by the engagement of the hook and the protrusion is applied to the stapler 45, the stapler 45 rotates around the rotational shaft 47.

Further, a portion of the rail 44 on which the binding device 40 is placed may be curved. That is, a portion of the straight rail 44 that is close to the corner Te is curved so as to extend towards the corner Te. As the binding device 40 moves towards the corner Te, the stapler 45 receives a force that pushes it towards the corner Te from the curved portion of the rail 44. When this force is received, the stapler 45 rotates around the rotational shaft 47.

Binding Operation of Stapleless Binding Mechanism 50

Next, the case in which the stapleless binding mechanism 50 performs a binding operation at the front-side edge portion Ta will be described.

Here, as mentioned above, the area of the stapleless binding portion 51 is larger than the area of the staple 41. Therefore, when, for example, transport positions of the sheets S in the image forming system 1 differ, the possibility with which the stapleless binding portion 51 having a large area overlaps images is increased. Therefore, when the stapleless binding mechanism 50 performs a binding operation, it is necessary to provide a sufficient distance from the images to the binding portion so as to reliably prevent the overlapping of the stapleless binding portion 51 and the images.

In order to provide the sufficient distance so as to reliably prevent the overlapping of the stapleless binding portion 51 and the images, in one mode, edges of the images formed on the sheets S are moved. In other words, the binding margin is widened. Further, in another mode, the position of the binding portion of the sheets S is moved away from the images.

By using either one of these two modes, it is possible to provide the sufficient distance from the images to the binding portion so as to reliably prevent the overlapping of the stapleless binding portion 51 and the images. Alternatively, a mode in which both of these modes are combined may also be used. These modes will hereunder be described.

Moving the Image

First, with reference to FIG. 1 and FIGS. 8A and 8B, the mode in which an edge of an image formed on a sheet S is moved will be described. Here, the operation that differs from the operation of the image forming system 1 when the above-described stapler 45 performs a binding operation at the front-side edge portion Ta will only be described.

Figure 8A:
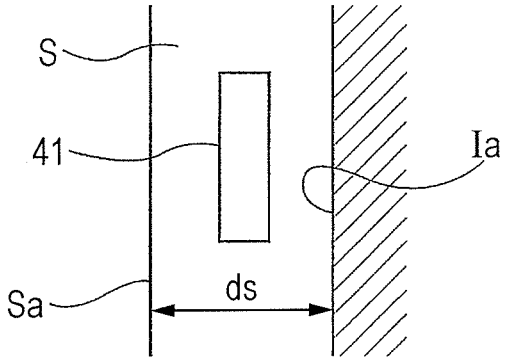
FIGS. 8A and 8B each illustrate the relationship between the position of a first edge portion Sa of a sheet S and the position of an image formed on the sheet S.
Figure 8B:
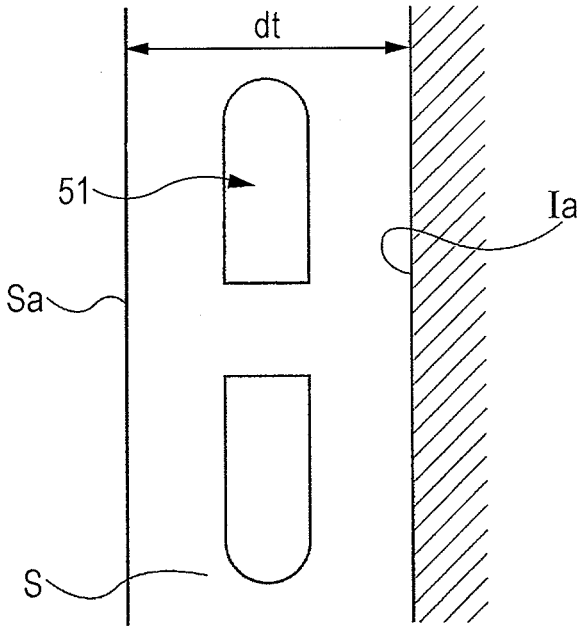

FIGS. 8A and 8B each illustrate the relationship between the position of the first edge portion Sa of a sheet S and the position of an image formed on the sheet S. FIG. 8A shows the relationship between the position of the image and the sheet S when the stapler 45 performs a binding operation. FIG. 8B shows the relationship between the position of the image and the sheet S when the stapleless binding mechanism 50 performs a binding operation.

When the stapleless binding mechanism 50 performs the binding operation, before the image forming section 5 forms the image on the sheet S, first, the controller 80 sends a control signal to the image forming section 5 so that the position of the image that the image forming section 5 forms is changed. Then, the image forming section 5 that receives the signal sets the distance from the edge portion of the sheet to the image that it forms so that this distance differs from that when the stapler 45 performs the binding operation.

More specifically, the relationships are as shown in FIGS. 8A and 8B. That is, the image forming section 5 is controlled so that the distance from the image edge Ia of the image (which is the edge of the image at the side of the first edge portion Sa) to the first edge portion Sa when the stapler 45 performs the binding operation differs from that when the stapleless binding mechanism 50 performs the binding operation.

When the stapler 45 performs the binding operation, the distance from the image edge Ia to the first edge portion Sa becomes a distance ds. In contrast, when the stapleless binding mechanism 50 performs the binding operation, the distance from the image edge Ia to the first edge portion Sa becomes a distance dt. The distance dt is longer than the distance ds by, for example, approximately 3 to 5 mm.

By changing the position of the image in this way, when the stapleless binding mechanism 50 performs the binding operation, a wider binding margin is provided. This makes it possible to reliably prevent the overlapping of the image and the stapleless binding portion 51.

Here, in the exemplary embodiment, the position of the image is only changed without changing, for example, the size of the image that is formed on the sheet S by the image forming section 5. The mode is one in which the image formed on the sheet S is moved along the sheet S.

However, the present invention is not limited thereto. Any structure that provides a wider binding margin when the stapleless binding mechanism 50 performs the binding operation may be used.

For example, the scale of the image that is formed when the stapler 45 performs the binding operation may be made to differ from that when the stapleless binding mechanism 50 performs the binding operation. More specifically, with the image when the stapler 45 performs the binding operation being a standard, the entire image when the stapleless binding mechanism 50 performs the binding operation may be scaled down without moving the center of the image.

Further, a structure that processes an image may also be used. More specifically, with the image when the stapler 45 performs the binding operation being a standard, the aspect ratio of the image when the stapleless binding mechanism 50 performs the binding operation may be changed. That is, the image is reduced in size in only a direction in which the image intersects the first edge portion Sa of the sheet S without moving the center in this direction.

Alternatively, each of the above-described modes may be combined. That is, the image may be scaled down while moving the image that is formed on the sheet S. Alternatively, the aspect ratio of the image may be changed while moving the image that is formed on the sheet S.

Moving the Binding Portion

Next, with reference to FIG. 1 and FIGS. 4A to 4C and FIGS. 9A and 9B, a mode in which the position of the binding portion of the sheet S is moved will be described.

Figure 9A:
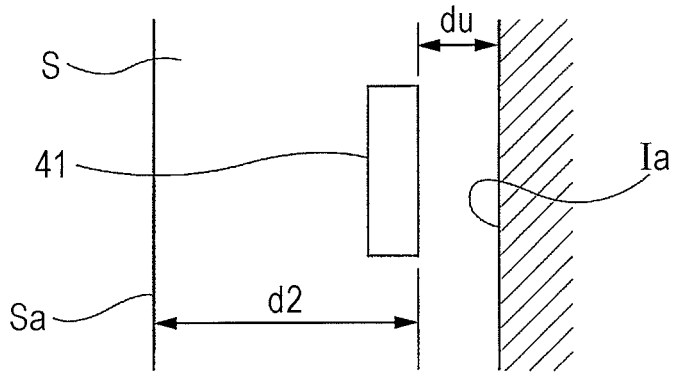
FIGS. 9A and 9B each illustrate the relationship between the position of a binding portion and the position of the image formed on the sheet.
Figure 9B:
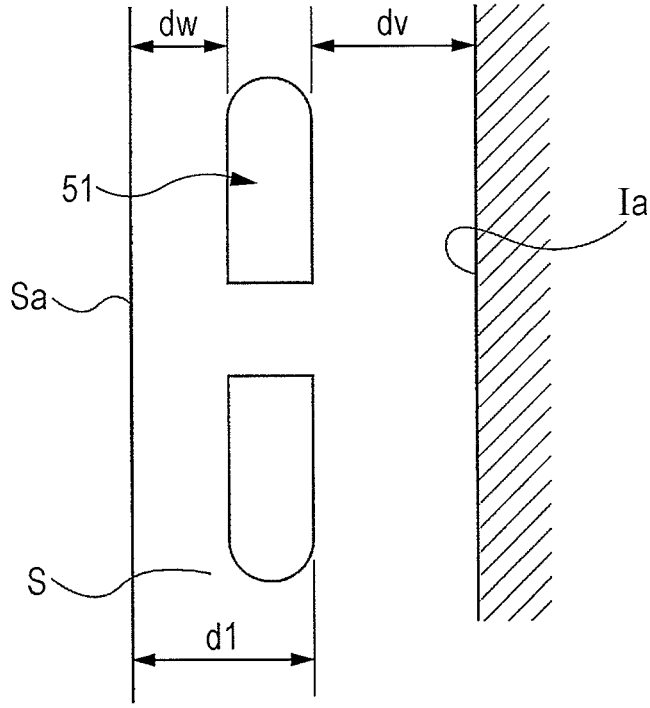

FIGS. 9A and 9B each illustrate the relationship between the position of the binding portion and the position of the image formed on the sheet S. FIG. 9A shows the relationship between the position of the staple 41 and the image. FIG. 9B shows the relationship between the position of the stapleless binding portion 51 and the image.

First, a comparative case in which the binding operation is performed by the stapler 45 will be described. Before the image forming section 5 forms the image on the sheet S, the controller 80 sends a control signal to the solenoids 35*d* so that the end guide 35*b* is disposed at a specified position.

When the stapler 45 performs the binding operation, if the solenoids 35*b* do not operate, the end guide 35*b* is disposed at the position Pey. Then, when the sheet S is disposed at the bottom portion 35*a* of the compiling stacking section 35, and is subjected to the binding operation, the distance from the first edge portion Sa to the edge of the binding portion (staple 41) at the image side becomes a distance d2. The distance from the edge of the binding portion at the image side to the image edge Ia becomes a distance du.

In contrast, when the stapleless binding mechanism 50 performs the binding operation, if the solenoids 35*d* are operated, the end guide 35*b* is disposed at the position Pex. Then, when the sheet S is disposed at the bottom portion 35*a* of the compiling stacking section 35, and is subjected to the binding operation, the distance from the first edge portion Sa to the edge of the binding portion (the stapleless binding portion 51) at the image side becomes the distance d1. The distance from the edge of the binding portion at the image side to the image edge Ia becomes a distance dv.

Here, the distance dv is either equal to or greater than the distance du. For example, the distance dv is greater than the distance du by approximately 3 to 5 mm.

By changing the position of the end guide 35*b* in this way, the distance dv becomes consequentially longer than the distance du. This makes it possible to reliably prevent the overlapping of the image with the binding portion.

As mentioned above, the distance d1 is less than the distance d2. In relation to this, if the position of the stapleless binding portion 51 is moved towards the first edge portion Sa of the sheet S, the sheet S tends to be torn. That is, if a distance dw from the side of the stapleless binding portion 51 adjacent to the first edge portion Sa to the first edge portion Sa of the sheet S is short, the sheet S tends to be torn. Therefore, in order not to tear the sheet S, it is necessary for the distance dw to be longer than a certain width.

Other Modes

Figure 10:
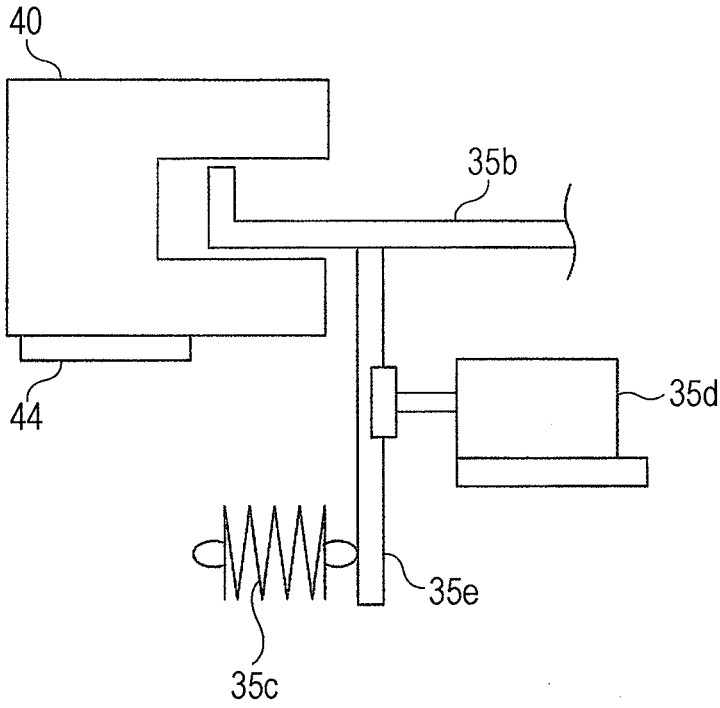
FIG. 10 is a side view of the vicinity of an end guide according to another mode.

With reference to FIG. 10, another mode of moving the end guide 35*b* will be described. FIG. 10 is a side view of the vicinity of the end guide 35*b* according to another mode.

As shown in FIG. 10, an operating plate 35*e* is disposed at the lower side of the end guide 35*b*. The operating plate 35*e* is provided in an orientation intersecting the bottom portion 35*a*. In addition, an end guide spring 35*c* is connected to one of the sides of the operating plate 35*e* at a position where the end guide spring 35*c* does not interfere with the operation of the binding device 40. For example, a housing of the postprocessing device 30 (not shown) is secured to an end portion differing from an end portion of the end guide spring 35*c* that is connected to the operating plate 35*e*. Further, a solenoid 35*d* is provided at a side of the operating plate 35*e* that is opposite to the side where the end guide spring 35*c* is disposed. The solenoid 35*d* is secured to, for example, the housing of the postprocessing device 30 (not shown). By operating the solenoid 35*d*, the end guide 35*b* is moved towards the bottom portion 35*a*, so that the end guide 35*b* is disposed at the position Pex where it is disposed close to the bottom portion 35*a*. When the solenoid 35*d* is not operated, the end guide 35*b* is disposed at the position Pey where it is disposed further away from the bottom portion 35*a*.

Although, in the above-described exemplary embodiment, the position of the binding device 40 is not moved in a direction intersecting the first edge portion Sa of a sheet S (that is, in a direction along the second edge portion Sb), the present invention is not limited thereto. For example, the binding device 40 includes a stage that is movable in a direction intersecting the rail 44. A solenoid 35*d* that moves the stage in the direction intersecting the rail 44 is connected. By driving the solenoid 35*d*, the binding device 40 is movable in the direction intersecting the first edge portion Sa of the sheet S. By using this structure, the distance from the first edge portion Sa of the sheet S to a binding portion may be changed.

Further, although, in the above-described exemplary embodiment, the stapleless binding mechanism 50 binds the sheets S using the flap 522 and the slit 521, the present invention is not limited thereto.

Figure 11A:
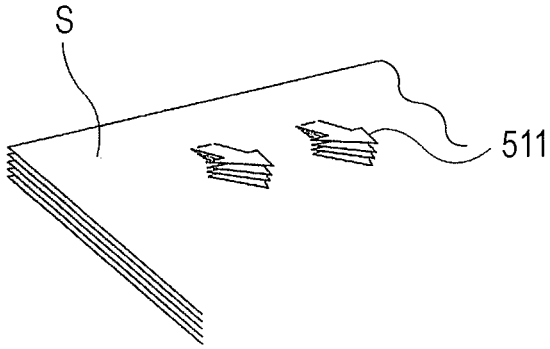
FIGS. 11A and 11B illustrate a bundle of sheets on which a stapleless binding operation is performed in another exemplary embodiment.
Figure 11B:
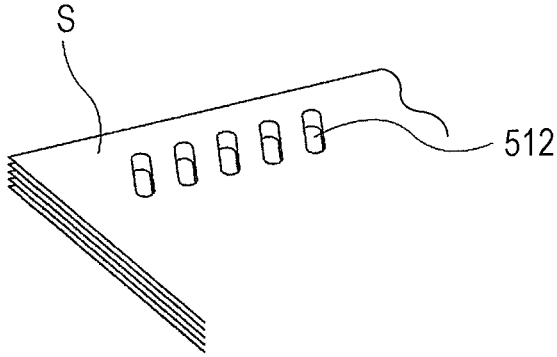

Here, a stapleless binding mechanism 50 in another exemplary embodiment will be described with reference to FIGS. 11A and 11B. FIGS. 11A and 11B illustrate a bundle of sheets S on which a stapleless binding operation is performed in another exemplary embodiment. FIG. 11A shows an example in which the binding operation is performed by forming arrow-like cut portions 511. FIG. 11B shows an example in which the binding operation is performed by forming embossed marks 512.

First, in a binding mode shown in FIG. 11A, the arrow-like cut portions 511 are formed in portions of the bundle of sheets S. The arrow-like cut portions 511 are punched with the ends of their shafts being kept continuous with the sheets S. Then, the arrow-like cut portions 511 are raised upward, and engage with punched holes, to hold the bundle of sheets S.

In contrast, in a binding mode shown in FIG. 11B, the bundle of sheets S is bound by forming the embossed marks 512 on portions of the bundle of sheets S. That is, a member (which forms the embossed marks 512 from an illustrated upper surface of the bundle of sheets S shown in FIG. 11B to the opposite surface of the bundle of sheets S) is pressed against the bundle of sheets S. This causes recessed portions to be formed at the surface of the bundle of sheets S that is capable of being seen in FIG. 11B (that is, protrusions are formed at the opposite surface of the bundle of sheets S), so that the binding operation is performed.

Further, although, in the above-described exemplary embodiments, as shown in FIG. 5, the stapler 45 and the stapleless binding mechanism 50 of the binding device each have a head, and the head of the stapler 45 rotates (refer to arrow B in FIG. 5), the present invention is not limited thereto. For example, it is possible for the stapler 45 and the stapleless binding mechanism 50 to have a common head, and for only a member of the stapler 45 that pushes in the staples 41 to be rotated.

Further, although, in the above-described exemplary embodiments, the binding device 40 includes one stapler 45 and one binding mechanism 50, the present invention is not limited thereto. For example, the binding device 40 may include two staplers 45 and a stapleless binding mechanism 50 disposed between the two staplers 45. This structure makes it possible to obliquely dispose a staple 41 even at another corner of each sheet S which is situated at the side of the first edge portion Sa and which differs from the corner Se.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing device comprising:

a stacking unit that is used to stack a bundle of sheets that are placed upon each other with first edge portions of the sheets being aligned with each other;

a first binding unit that binds the first edge portions of the bundle of sheets stacked upon the stacking unit;

a second binding unit that is provided integrally with the first binding unit in a direction along the first edge portions of the bundle of sheets stacked upon the stacking unit, the second binding unit binding the first edge portions by a binding method differing from a binding method of the first binding unit and the second binding unit being a stapleless binding unit; and an angle changing mechanism that is capable of changing an angle of the first binding unit with respect to the bundle of sheets when binding the first edge portions with the first binding unit, wherein the angle changing mechanism is capable of changing an angle of the first binding unit with respect to the first edge portions so that the angle of the first binding unit with respect to the first edge portions when the first binding unit binds a corner of each sheet is different from that when the first binding unit binds a portion of each sheet other than the corner, and wherein the first binding unit and the second binding unit are connected to each other so that an angle between the first binding unit and the second binding unit is changeable, and wherein the angle changing mechanism rotates the first binding unit to change the angle of the first binding unit with respect to the bundle of sheets while maintaining the connection between the first binding unit and the second binding unit.

2. The sheet processing device according to claim 1, wherein the first binding unit binds the first edge portions by driving a staple through the first edge portions, and the second binding unit binds the first edge portions by deforming the sheets without using the staple.

3. An image forming apparatus comprising:

an image forming unit that forms an image on a sheet;

a stacking unit that is used to stack a bundle of sheets that are placed upon each other with first edge portions of the sheets being aligned with each other, the sheets having images formed thereon by the image forming unit;

a staple binding unit that binds the first edge portions of the bundle of sheets by driving a staple through the first edge portions, the bundle of sheets being stacked upon the stacking unit;

a sheet binding unit that is provided integrally with the staple binding unit in a direction along the first edge portions of the bundle of sheets stacked upon the stacking unit, the sheet binding unit forming in the sheets a partially punched sheet piece having one portion thereof connected to the sheets, forming a cut in the sheets, and inserting an end portion of the partially punched sheet piece into the cut, to bind the first edge portions, wherein the sheet binding unit is a stapleless binding unit; and an angle changing mechanism that is capable of changing an angle of the staple binding unit with respect to the bundle of sheets when binding the first edge portions with the staple binding unit, wherein the angle of the staple binding unit with respect to the first edge portions when the staple binding unit binds a corner of each sheet is different from that when the staple binding unit binds a portion of each sheet other than the corner, and wherein the staple binding unit and the sheet binding unit are connected to each other so that an angle between the staple binding unit and the sheet binding unit is changeable, and wherein the angle changing mechanism rotates the staple binding unit to change the angle of the staple binding unit with respect to the bundle of sheets while maintaining the connection between the staple binding unit and the sheet binding unit.

* * * * *